US005285242A

United States Patent [19]

Kotani

[11] Patent Number: 5,285,242

[45] Date of Patent: Feb. 8, 1994

[54] IMAGE FORMING APPARATUS CONTROLLED ACCORDING TO CHANGING SENSITIVITY OF PHOTOCONDUCTOR

[75] Inventor: Akio Kotani, Aichi, Japan

[73] Assignee: Minolta Camera Kabushiki Kaisha, Osaka, Japan

[21] Appl. No.: 39,876

[22] Filed: Mar. 30, 1993

[30] Foreign Application Priority Data

Mar. 31, 1992 [JP] Japan ..... 4-108710

[51] Int. Cl.[5] ..... G03G 15/00

[52] U.S. Cl. ..... 355/208; 355/210; 355/308

[58] Field of Search ..... 355/208, 210, 228, 246, 355/308

[56] References Cited

U.S. PATENT DOCUMENTS

| | | | |
|---|---|---|---|
| 3,575,505 | 4/1971 | Parmigiani | 355/246 |
| 4,136,945 | 1/1979 | Stephens | 355/208 |
| 4,375,328 | 3/1983 | Tsuchiya et al. | 355/210 |
| 4,935,777 | 6/1990 | Noguchi et al. | 355/210 |

FOREIGN PATENT DOCUMENTS 63-191161 8/1988 Japan .

*Primary Examiner*—Joan H. Pendegrass

*Attorney, Agent, or Firm*—Willian Brinks Hofer Gilson & Lione

[57] ABSTRACT

An image forming apparatus having a photosensitive member, an image forming device which forms an image by forming an electrostatic latent image on the photosensitive member and developing the electrostatic latent image in accordance with an image forming condition, a copy number detector for counting the number of images formed by the image forming device, a first control program for correcting the image forming condition in accordance with a correction value whenever a predetermined number is counted by the copy number detector, a second control program for manually regulating the image forming condition corrected by the first control program, a memory for storing the image forming condition regulated by the second control program, and a third control program for revising the correction value in accordance with the image forming condition stored by the memory.

14 Claims, 12 Drawing Sheets

IMAGE FORMING APPARATUS CONTROLLED ACCORDING TO CHANGING SENSITIVITY OF PHOTOCONDUCTOR

BACKGROUND OF THE INVENTION

1. Field of the Invention

The present invention relates to an image forming apparatus capable of suitably correcting an exposure light value in accordance with the deterioration of the sensitivity of a photosensitive member.

2. Description of the Related Art

In conventional image forming apparatus, Se, Cds and OPC (organic photoconductor) are used as materials for photosensitive members. However, when photosensitive members produced of such materials are subjected to repeated charging, charge elimination, light exposure, toner adhesion and the like, the sensitivity of said photosensitive member gradually deteriorates and does not match the initial conditions of the image forming apparatus.

Generally, image forming apparatus such as, for example, copying apparatus, are constructed such that the quality of a produced copy image is visually judged, and a service person adjusts the exposure lamp voltage, developing bias voltage to set the surface potential of the photosensitive member, or the number of produced copies is counted and when a predetermined number of copies is attained, the exposure voltage value and the like are corrected.

The aforesaid method whereby the quality of a produced copy is visually judged and the image forming conditions are then adjusted is disadvantageous insofar as it is based on a vague judgement standard. Further, the method whereby the number of copies is counted and exposure voltage value and the like are corrected when a predetermined number of copies is attained is disadvantageous in that the degree of deterioration in sensitivity of the photosensitive member varies not only in relation to the number of copies but also through operating conditions of the copying apparatus, such that over long-term operation the image forming conditions become mismatched.

SUMMARY OF THE INVENTION

A main object of the present invention is to provide an image forming apparatus capable of correcting image forming conditions in accordance with the degree of deterioration of sensitivity of the photosensitive member.

The aforesaid objects of the present invention are achieved by providing an image forming apparatus comprising:

an image bearing member;

image forming means for forming an image by forming an electrostatic latent image on said image bearing member, and developing said formed electrostatic latent image thereon;

regulating means for regulating the image forming conditions of said image forming means;

counting means for counting the number of images formed by said image forming means;

memory means for storing the image forming conditions adjusted by said regulating means;

correcting means for correcting the image forming conditions in accordance with previously determined correction values when a predetermined number is counted by said counting means; and revising means for revising the correction values in accordance with the difference between said regulating value stored in the memory means and at least one or more prior regulating values including the initial value, and the number of image formations.

These and other objects, advantages and features of the invention will become apparent from the following description thereof taken in conjunction with the accompanying drawings will illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

The preferred embodiments of the present invention are described hereinafter in conjunction with the accompanying drawings.

Figure 1:
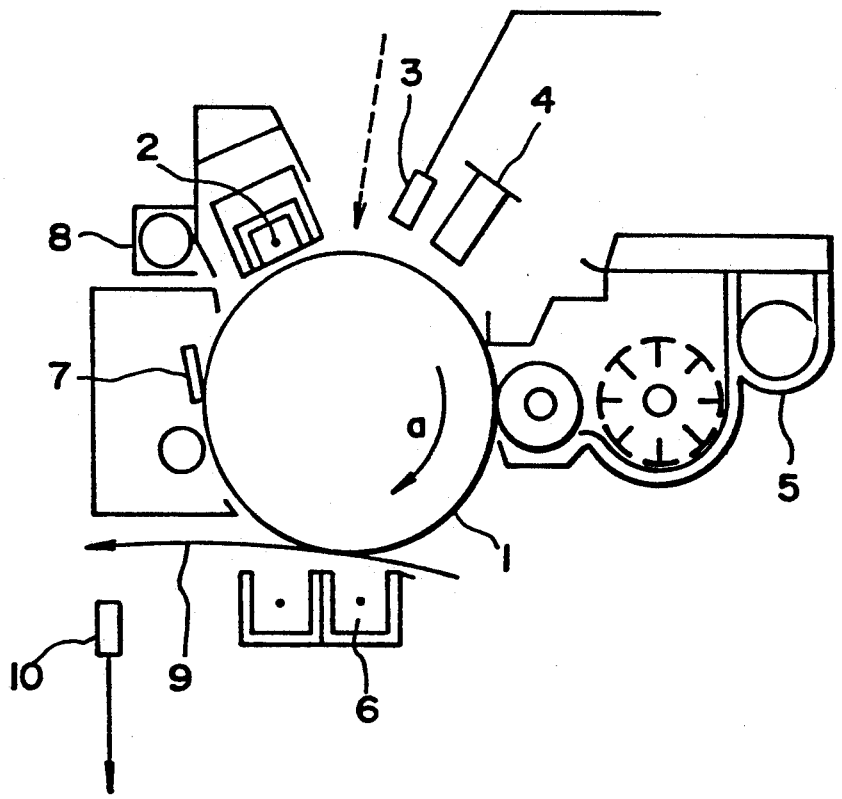
FIG. 1 is a section view briefly showing the construction of a copying apparatus, i.e., the image forming apparatus of the present invention.

FIG. 1 is a section view showing the image forming apparatus of the present invention constructed in the form of a copying apparatus. In the drawing, the photosensitive member 1 is an organic type photosensitive member which is rotatably driven in the direction indicated by arrow a. Arranged sequentially around the photosensitive member 1 in the direction of rotation are a charger 2, surface potential sensor 3 for detecting the surface electrical potential of the photosensitive member 1, light source 4, developing device 5, transfer charger 6, cleaning device 7, and light source 8.

When the aforesaid photosensitive member 1 is rotatably driven in the arrow a direction, the surface of the photosensitive member 1 is uniformly charged by the charger 2, then exposed with the exposure light of the original document image at the exposure portion (not illustrated) so as to form an electrostatic latent image thereon. The unnecessary latent image is erased by the exposure light from the light source 4.

Then, the electrostatic latent image formed on the surface of the photosensitive member 1 is developed by the developing device 5, the developed image is transferred via the transfer charger 6 onto a transfer paper 9 transported from a paper feed unit (not illustrated), the developed image is subsequently fused onto the transfer paper 9 at the fixing portion (also not illustrated), whereupon the transfer paper 9 is discharged as a completed copy. Thereafter, the surface of the photosensitive member 1 is cleaned by the cleaning device 7, and completely discharged via the light source 8 in preparation for reuse. A copy number detector 10 is provided on the transfer paper 9 discharge side to detect the number of copy sheets by detecting the passage of the completed copy. The detection signal of the copy number detector 10 is transmitted to the CPU 201 (refer to FIG. 4) described later.

The surface electrical potential sensor 3 may be of a common type such as, for example, that disclosed in Japanese Patent Application No. 63-309978. The surface potential sensor 3 applies a voltage of a predetermined frequency to the surface of the photosensitive member 1, and measures the amount of change in the return oscillation to detect the surface potential, then transmits the detection results to the CPU 201. The surface potential sensor 3 may measure the surface potential of a part of the photosensitive member 1 on which is exposed a test document image, or may measure the surface potential of a the erased part after the surface of the photosensitive member 1 is erased, i.e., said sensor 3 measures the surface potential which is variable in accordance with the degree of deterioration in sensitivity of the photosensitive member 1.

Figure 2:
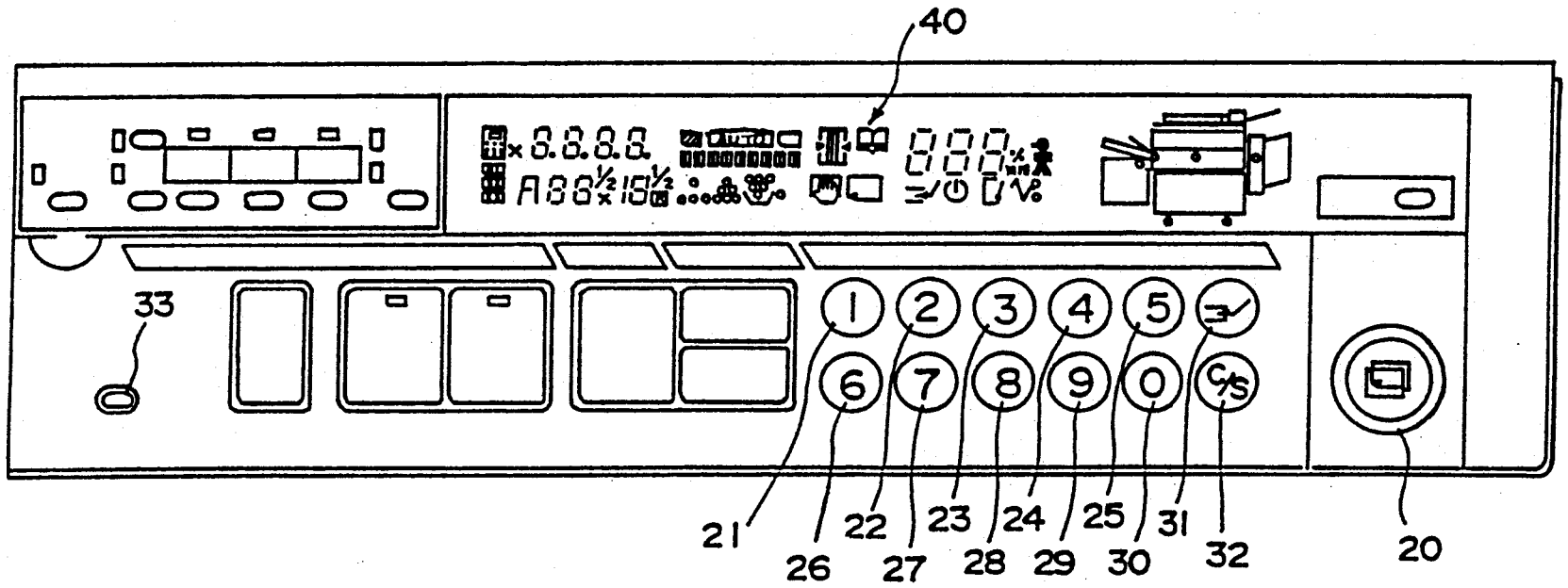
FIG. 2 is a top view showing the operation panel of the copying apparatus.

FIG. 2 is a top view showing the operation panel of the aforesaid copying apparatus.

The operation panel comprises a print key 20, ten key pad with ten numeric keys 21~30 for inputting the number of copies, interrupt key 31 for generating an interrupt, clear key 32 for clearing set numbers such as the input copy number and the like, exposure lamp voltage value adjusting key 33 for setting the adjustment mode for manual adjustment of the exposure lamp voltage value when replacing the photosensitive member and when the sensitivity of the photosensitive member has deteriorated, and a centralized display portion 40 of fluorescent display tubes.

Figure 3:
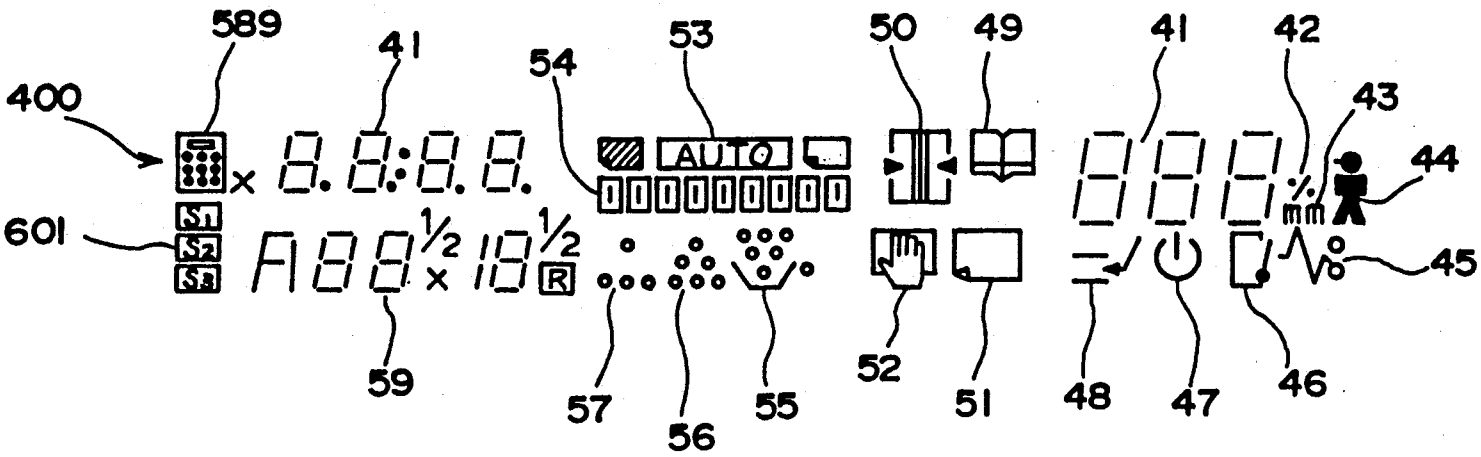
FIG. 3 is an enlargement of the centralized display portion of the operation panel.

FIG. 3 is an enlargement showing the centralized display portion 40. In the present embodiment, the four-digit display portion 41, which combines the copy magnification display and the clock display for indicating the remaining number of possible copies and the next cycle maintenance time by displaying the maintenance counter count value and the total count value for counting the total number of copies, and the 3-digit copy number display portion 42 are combined for use as a seven-digit continuous display portion. When this display is operative, other display portions are stopped (lighting is turned off) to improve visibility.

The serviceperson mark 44 is a maintenance call display, which when lighted warns of the necessity of replacing the photosensitive member. The serviceperson mark 44 is lighted when the remaining number of possible copies is less than a predetermined number.

Figure 4:
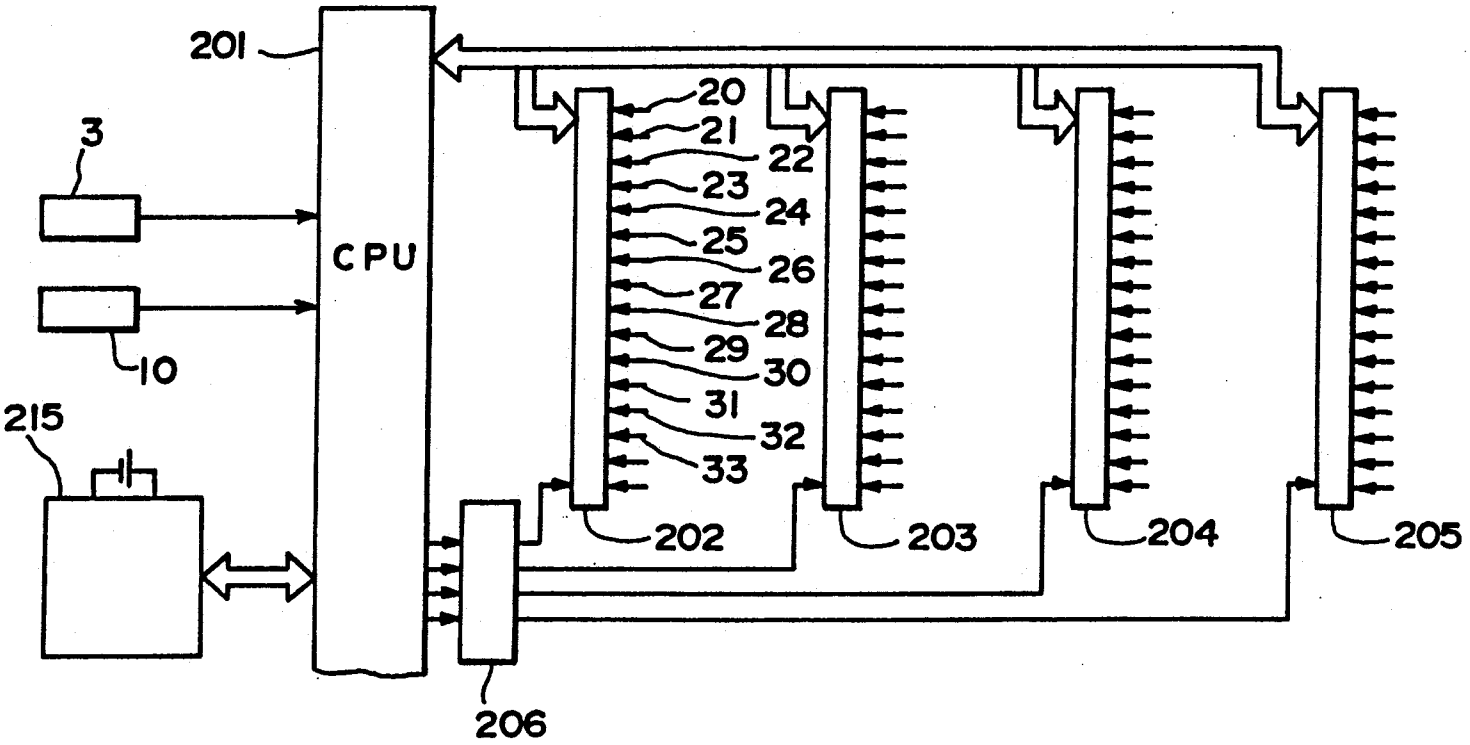
FIG. 4 is a block diagram showing the CPU input/output information for the main control of the copying apparatus.
Figure 5:
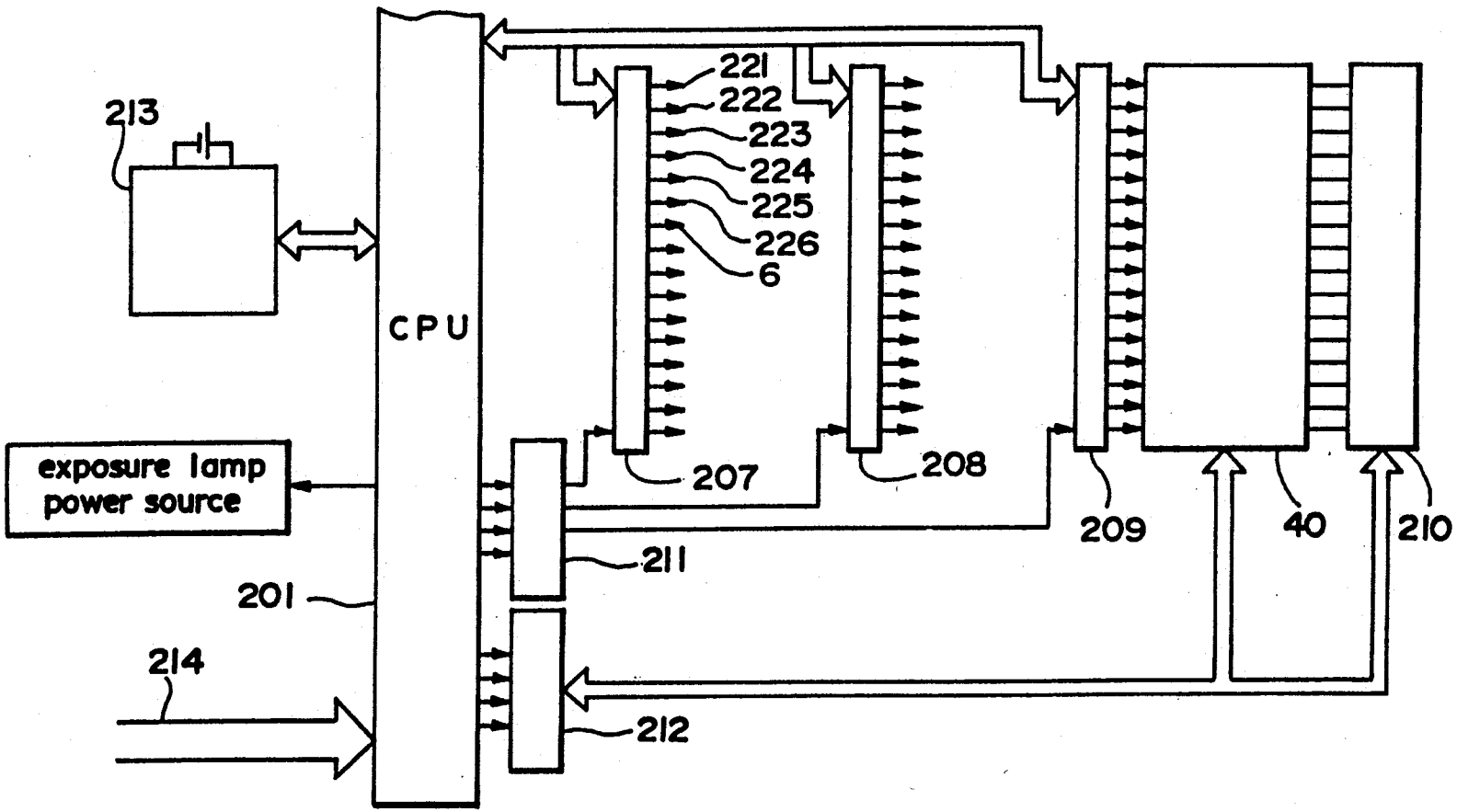
FIG. 5 is a block diagram showing the CPU input/output information for the main control of the copying apparatus.

FIGS. 4 and 5 are illustrations showing the CPU 201 input/output (I/O) information for the main control of the copying apparatus. The random access memory (RAM) 213 for battery-supported memory backup, and the clock integrated circuit (IC) 215 for timing are connected to the CPU 201. The various detection signals from the surface potential sensor 3, and copy number detector 10 are transmitted to the CPU 201. The bus 214 is a communication line used to connect the CPU 201 with the other CPUs.

Connected to the CPU 201 are the twelve keys 21-32 of the operation panel through the decoder 206 and input expansion ICs 202-205, various drivers for the main motor 221, the timing roller clutch 223, paper feed roller clutches 224 and 225, charger 226, and transfer charger 6 through the decoder 221 and the expansion ICs 207-209, as well as the fluorescent display tube of the centralized display portion 40 through the decoder 212, and the operation panel ON LED drive diode matrix 210 via the decoder 212.

The operation of the copying apparatus of the previously described construction is described hereinafter.

Figure 6:
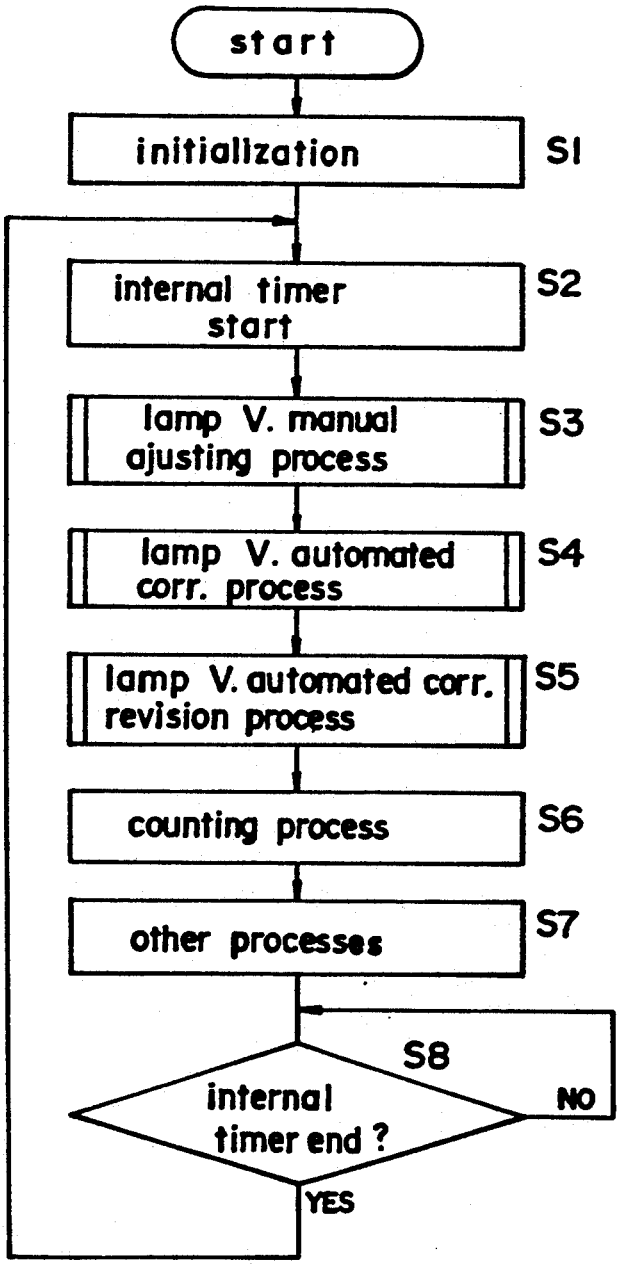
FIG. 6 is a flow chart showing the main routine of the CPU.

FIG. 6 is a flow chart showing the main routine of the aforesaid CPU 201.

When the power is turned on and the program starts, first, in step S1, each portion is initialized. Then, in step S2, an internal timer is set to set the length of one routine of the CPU 201.

In step S3, a process is executed to allow the serviceperson to manually adjust the exposure lamp voltage after visually determining the image quality of the obtained copy when replacing the photosensitive member or in accordance with the deterioration in the sensitivity of the photosensitive member.

In step S4, a process is executed wherein the exposure lamp voltage is automatedly corrected by predetermined values in accordance with the deterioration in the sensitivity of the photosensitive member when the number of produced copies is counted and a predetermined number is reached.

In step S5, a process is executed for revising the exposure lamp voltage automated correction value executed in step S4, or in step S6 a process is executed to count the number of discharged copies.

Then, in step S7, other processes are executed, e.g., copy operation, communication processes with other CPUs and the like. In step S8, the end of the internal timer is awaited; when the internal timer ends, the program returns to step S2. While the power is turned on, the processes of steps S2 through S8 are repeated.

Figure 7:
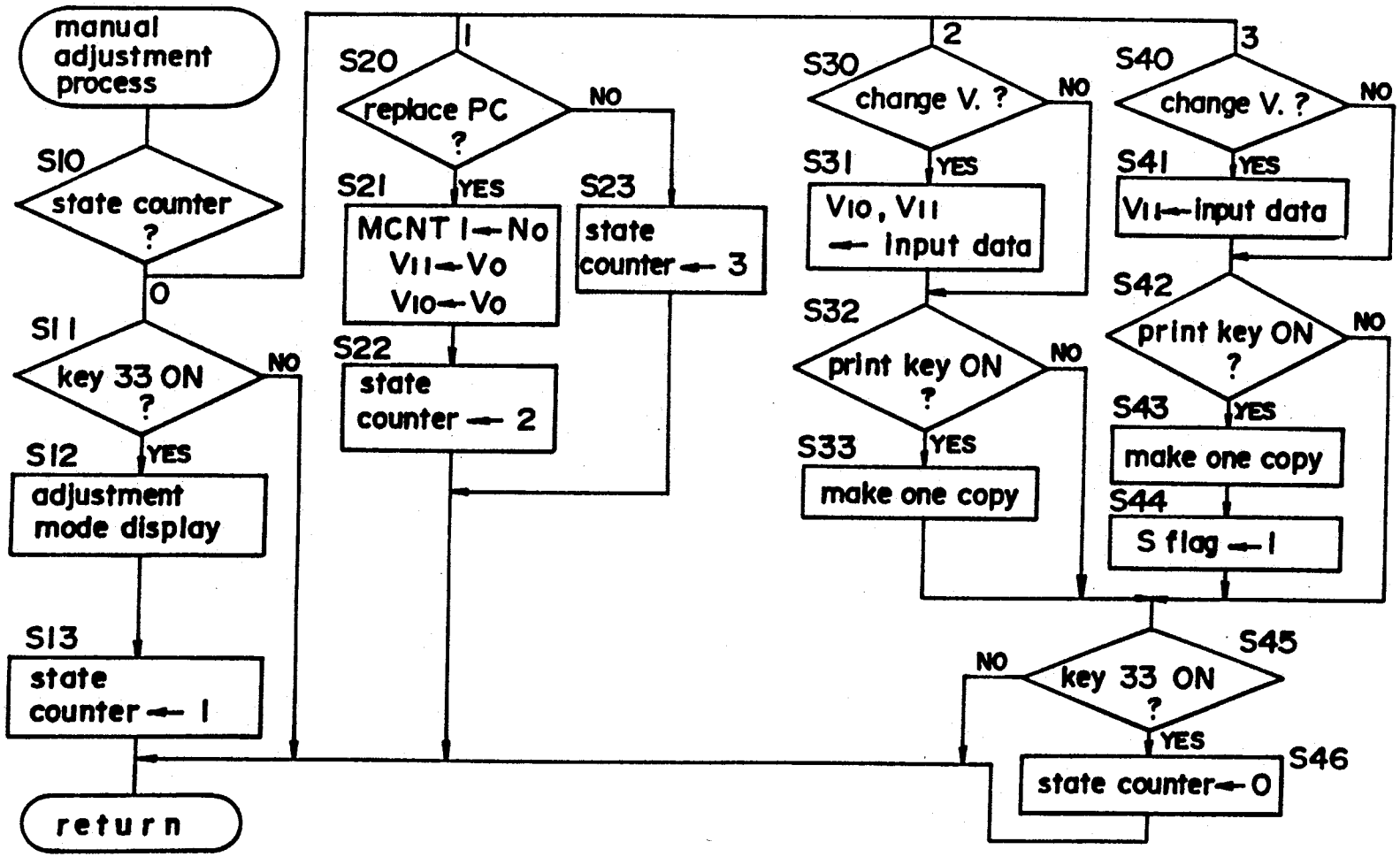
FIG. 7 is a flow chart showing the exposure voltage manual regulating process of FIG. 6.

FIG. 7 is a flow chart showing the manual adjustment process subroutine for adjusting the exposure lamp voltage in step S3 of FIG. 6.

The process of this subroutine is started by the input of the exposure lamp voltage value adjustment key 33 shown in FIG. 2. The actuation of key 33 allows for a service person to adjust the exposure lamp voltage through numeric input from the ten keys 21~30 on the operation panel, and subsequently verify said setting through a copy sample image quality verification.

In step S10, first a state check is made, and the processes described below are executed in accordance with the detected state.

When the state is [0], a check is made in step S11 to determine whether or not the exposure lamp voltage value adjustment key 33 has been depressed. When the key 33 has been depressed, the adjustment mode is set and the adjustment mode is displayed on the operation panel in step S12, and the state is set at [1] in step S13.

When the state is [1], the input process is executed for adjustment of the exposure lamp voltage value in accordance with replacement of the photosensitive member, or in accordance with the deterioration in sensitivity of the photosensitive member. In step S20, a check is made to determine whether or not the photosensitive member is replaced. An affirmative determination (YES) is made by, if adjustment is in conjunction with photosensitive member replacement, input of the exposure lamp voltage value adjustment key 33 while depressing the interrupt key 31 on the operation panel. Conversely, a negative determination (NO) is made when input is from the exposure lamp voltage value adjustment key 33 only.

When the determination in step S20 is YES, the initial value No. is set in the counter MCNT1 to determine the replacement time and service life of the photosensitive member, and predetermined initial values $V_0$ are stored as the exposure lamp voltage initial value $V_{10}$ and the exposure lamp voltage post-correction value $V_{11}$, then the state is set at [2] in step S22. When the determination is NO in step S20, the state is set at [3].

In state [2], adjustment is accomplished in conjunction with photosensitive member replacement. First, in step S30, a check is made to determine whether or not the respective voltages V, i.e., exposure lamp voltage initial value $V_{10}$ and the exposure lamp voltage post-correction value $V_{11}$, have changed and whether or not there is input from the ten key pad on the operation panel. If there is no change, (reply to query in step S20 is NO), the routine advances to step S32, whereas if there is a change (reply to query in step S20 is YES), the routine continues to step S31. In step S31, the voltages values input for the exposure lamp voltage initial value $V_{10}$ and the exposure lamp voltage post-correction value $V_{11}$ are changed, and the routine continues to step S32. In step S32, a check is made to determine whether or not the there is input from the print key; if there is no print key input (step S32: NO), the routine advances to step S45. If there is print key input (step S32: YES), the routine continues to step S33, a copy sample image is made and the image quality verified, whereupon the routine advances to step S45. The voltage value input in step S30 is displayed in the seven digit display portion.

In state [3], adjustment is accomplished in accordance with the deterioration in sensitivity of the photosensitive member. In step S40, a check is made to determine whether or not the exposure lamp voltage post-correction value $V_{11}$ has changed or there is input from the ten key pad on the operation panel. If there is no change (step S40: NO), the routine advances to step S42, whereas if there is a change (step S40: YES), the routine continues to step S41, the exposure lamp voltage post-correction value $V_{11}$ is changed to the input voltage value, and the routine continues to step S42. In step S42, a check is made to determine whether or not there is print key input. If there is no print key input (step S42: NO), the routine advances to step S45, whereas if there is print key input (step S42: YES), a copy sample is produced and the image quality verified in step S43, then the S-flag is set to enable a check to determine whether or not the correction revision process is executed in step S44, whereupon the routine continues to step S45.

In step S45 as check is made to determine whether or not there is input from the exposure lamp voltage adjustment key. If there is not such key input (step S45: NO), the routine returns directly, whereas if there is such key input (step S45: YES), the routine advances to step S46, the state counter is reset, and the routine returns.

Figure 8:
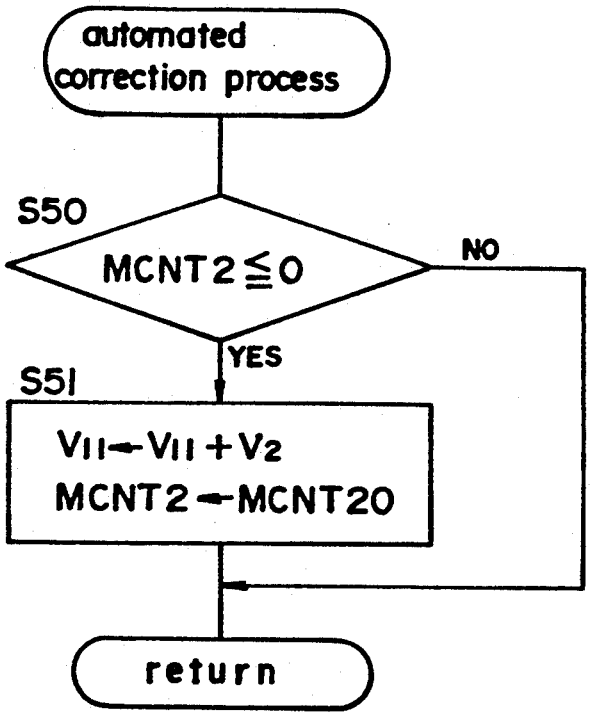
FIG. 8 is a flow chart showing the automated correction process routine of FIG. 6.

FIG. 8 is a flow chart showing the exposure lamp voltage automated correction process subroutine of step S4 in FIG. 6.

Figure 9:
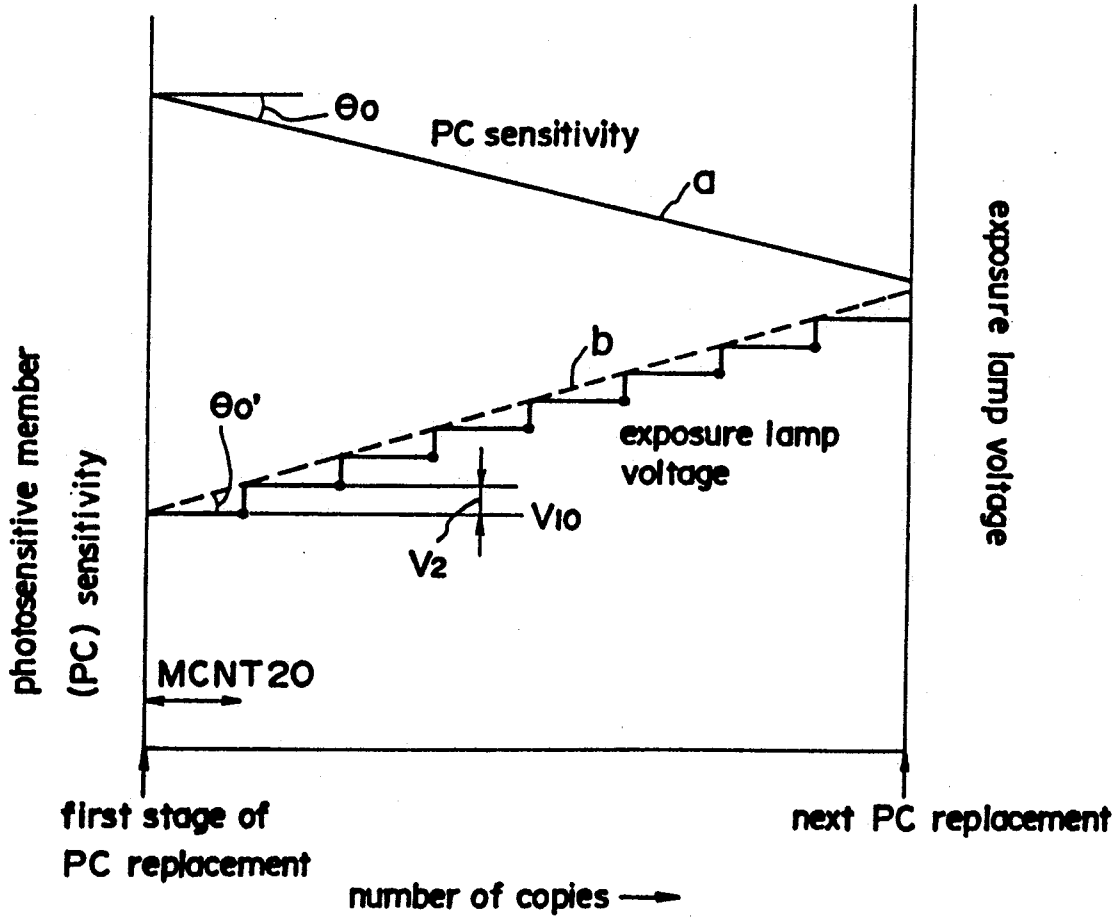
FIG. 9 is a graph showing the contents of the exposure lamp voltage automated correction process.

This routine executes a predetermined voltage correction process whenever a predetermined copy number is attained, as shown in FIG. 9. In this case, the slope of the graph showing the relationship between the correction voltage value $V_2$ and a predetermined copy number is calculated in accordance with experimental data. For example, the voltage may be corrected by 1 V every 5,000 copies. In step S50, a check is made to determine whether or not the copy number count MCNT is less than 0, i.e., to determine whether or not the voltage correction has attained the required copy number. If the reply to the query in step S50 is YES, the sum of the combined voltage of the exposure lamp voltage port-correction voltage $V_{11}$ and the voltage correction value $V_2$ is stored, and the initial value MCNT20, e.g., 5,000, is stored in the predetermined copy number counter MCNT2 to set the predetermined copy number for accomplishing voltage correction.

FIG. 9 is a graph showing the relationship between the number of copies, photosensitive member sensitivity, and exposure lamp voltage in the image forming apparatus of the present invention. For example, when the relationship between the number of copies and the deterioration of sensitivity of the photosensitive member after experimental use is indicated by the solid line a (slope $\theta_0$), the exposure lamp voltage initial value is the value $V_{10}$, and the number of copies attains a predetermined number, the exposure lamp voltage is correctly in steps (step height is $V_2$) along the dashed line b (slope $\theta_0'$) in accordance with the deterioration in sensitivity of the photosensitive member.

Figure 10:
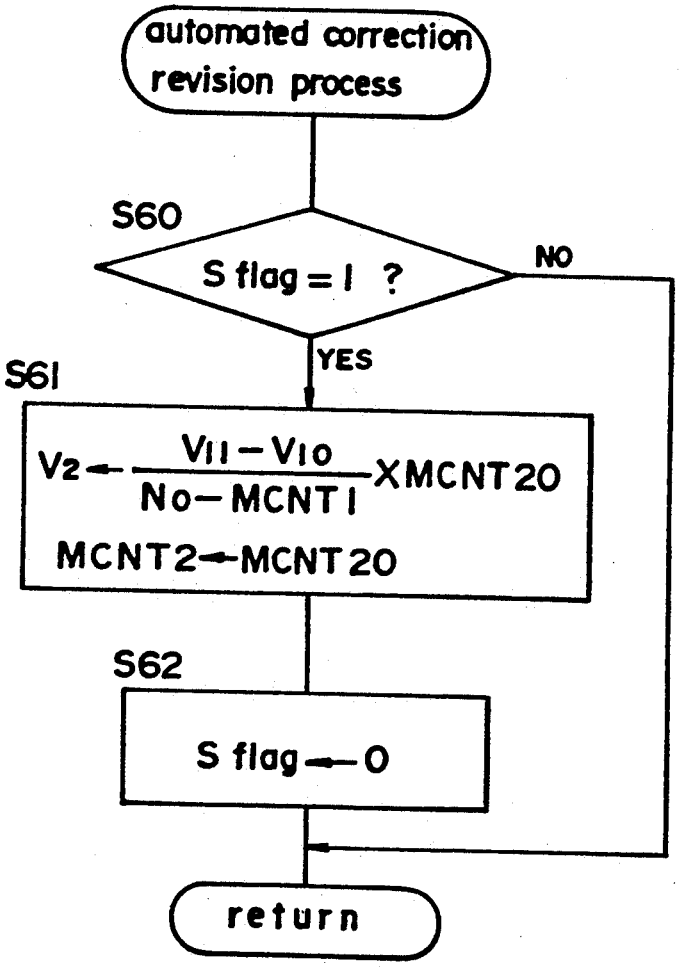
FIG. 10 is a flow chart showing the contents of the exposure lamp voltage automated correction revision process of FIG. 6.

FIG. 10 is a flow chart showing the exposure lamp voltage automated correction revision process subroutine of step S5 in FIG. 6.

Figure 11:
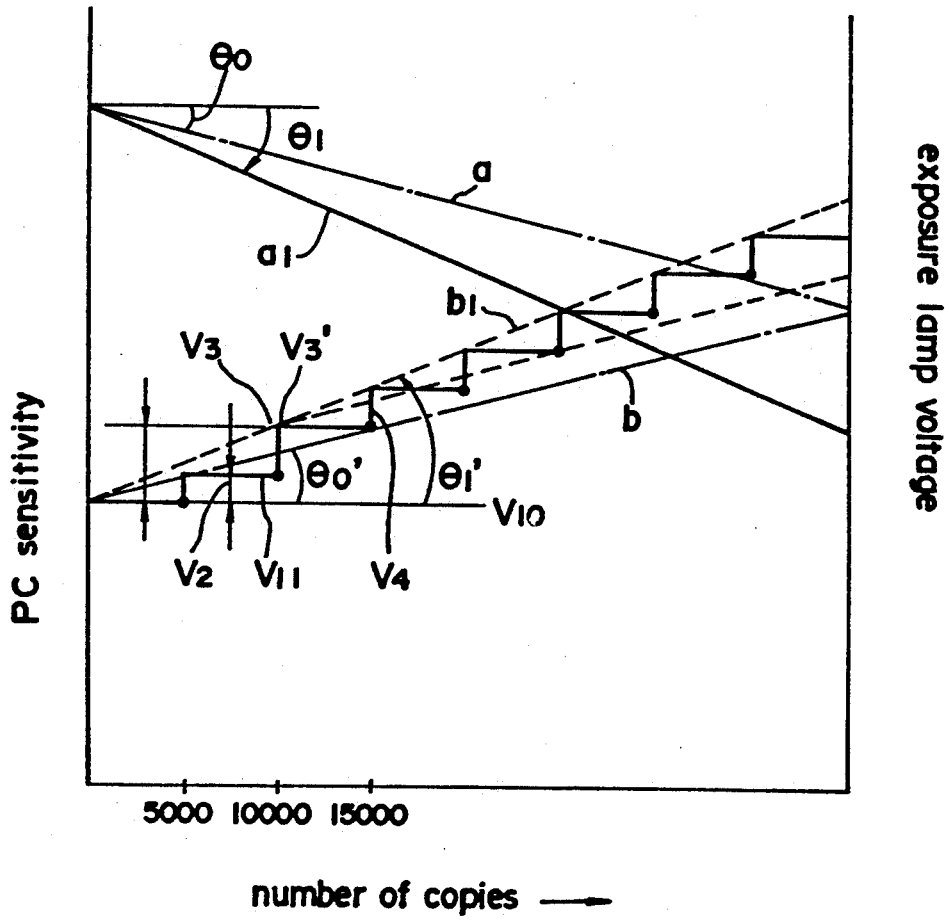
FIG. 11 is a graph showing the contents of the automated correction revision process

This subroutine is executed to counteract disagreements such as when the slope of deterioration is $\theta_1$ due to actual environmental variations and discrepancies in individual apparatus relative to the slope $\theta_0$ determined through test data of the deterioration in sensitivity of the photosensitive member, as shown in FIG. 11.

When a serviceperson finds the number of copies has reached 10,000, or the copy quality is checked by visual inspection thereafter, the difference between the suitable exposure lamp voltage and the exposure lamp voltage $V_{10}$, i.e., the initial image forming conditions of the photosensitive member, and the deterioration slope $\theta_1$ are calculated. The automated correction voltage value is then revised along the dashed line $b_1$ to match the individual apparatus.

In step S60, a check is made to determine whether or not the S-flag stored in step S44 is still stored. If the reply to the query is YES, the correction voltage $V_2$ is obtained in step S61 in accordance with the equation below, and the correction coefficient MCNT20 (5,000) is stored in MCNT2.

$$V_2=\{(V_{11}-V_{10})/(N_0-\mathrm{MCNT1})\}*\mathrm{MCNT20}.$$

Then, the S-flag is reset in step S62.

FIG. 11 is a graph showing the relationship between the number of copies, sensitivity of the photosensitive member, and exposure lamp voltage in the image forming apparatus of the present invention. In the drawing, the dashed line a expresses the degree of deterioration of the photosensitive member previously measured at the time of initial setting of the exposure lamp voltage, and the solid line a1 expresses the actual degree of deterioration. However, since the exposure lamp voltage initial value is set at $V_{10}$, when the number of copies reaches 5,000 the voltage is automatedly corrected to a predetermined voltage $V_2$ via the automated correction process, but when the copy number reaches 10,000, the value is corrected to $V_2+V_3$ ($=2V_2$) via CPU calculations and the serviceperson corrects said value to $V_2+V_3'$. Thus, the correction in the next cycle after the number of copies attains 5,000 sheets is $V_{10}$, $V_2+V_3'$, and the correction values fall along the dashed line b1, are calculated and displayed in accordance with 15,000 copies.

At this time, if the serviceperson again makes revisions, the slope for the future correction standard thereafter is newly calculated and displayed along the line derived after the new revision.

Figure 12:
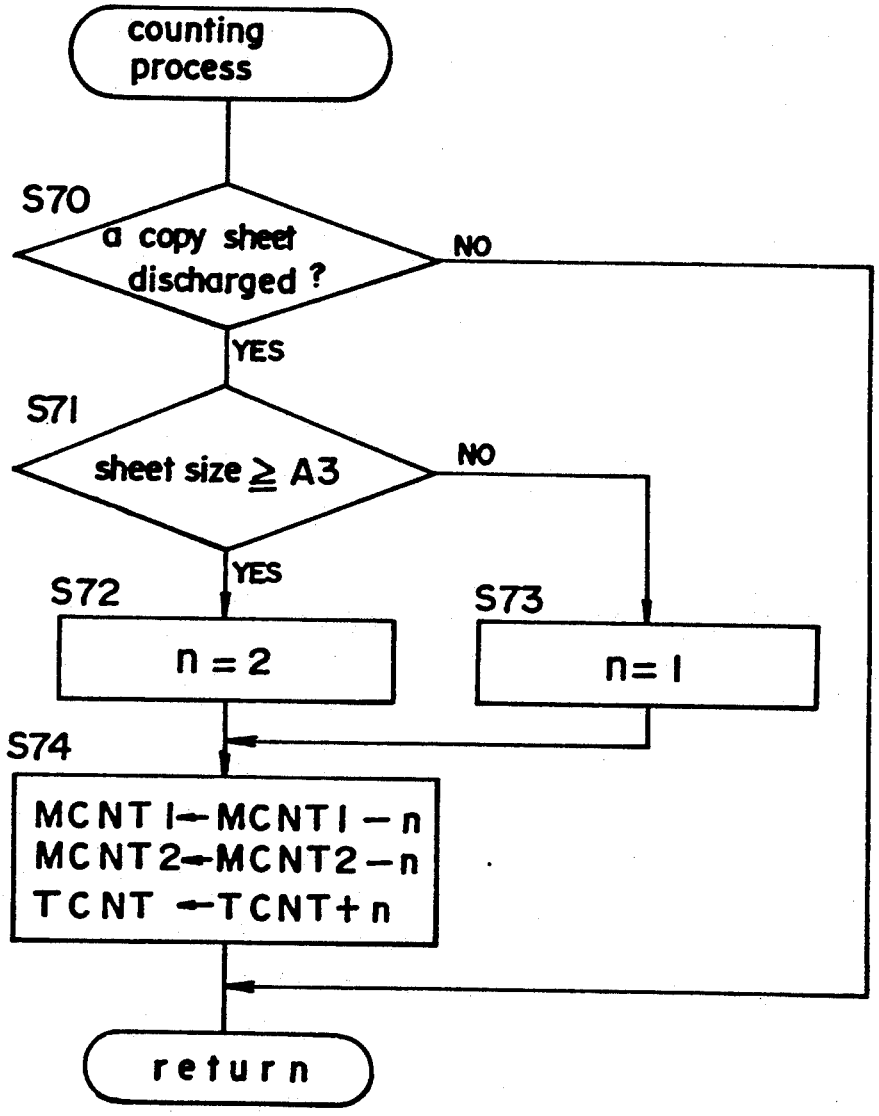
FIG. 12 is a flow chart showing the counting process routine of FIG. 6.

FIG. 12 is a flow chart showing the previously mentioned counting process subroutine.

In this subroutine, the count values MCNT1, MCNT2, and TCNT are added or subtracted depending on the detection signals of the copy number detector 10 and differences in paper size.

First, in step S70, a check is made to determine whether or not the detection signal of the copy number detector 10 has been input, i.e., whether or not a copy sheet has been discharged. If the reply to the query is YES, a check is made in step S71 to determine whether or not the paper size is A3 or greater. If the paper size is A3 or greater, the addition or substraction value n is set at 2, whereas if the paper size is less than A3, n is set at 1 in step S73.

In step S74, the print set value MCNT1 is set as the value MCNT1−n, the print set value MCNT2 is set as the value MCNT2−n, and the total count TCNT value is set as TCNT+n.

Although the exposure lamp voltage was adjusted as the image forming condition in the present embodiment, it is to be noted that other image forming conditions may be adjusted such as the charge amount applied to the photosensitive member, the developing bias voltage and the like.

Furthermore, the present embodiment has been described in terms of correcting the image forming conditions per a predetermined number of copies, and revising said correction value per a predetermined number of copies, it is to be understood that the correction value may be made constant, and the timing for executing such correction may be changed, i.e., the predetermined number of copies may be changed.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus comprising:

an image bearing member;

image forming means for forming an image by forming an electrostatic latent image on said image bearing member and developing the electrostatic latent image in accordance with an image forming condition;

counting means for counting the number of images formed by said image forming means;

correcting means for correcting the image forming condition in accordance with a correction value whenever a predetermined number is counted by said counting means;

regulating means for manually regulating the image forming condition corrected by said correcting means;

memory means for storing the image forming condition regulated by said regulating means; and revising means for revising the correction value in accordance with the image forming condition stored by said memory means, so that the following correction of image forming condition by said correcting means is executed in accordance with the correction value revised by said revising means.

2. An image forming apparatus as defined in claim 1, wherein said revising means revises the correction value in accordance with the number of images formed by said image forming means as well as the difference between the image forming conditions at present and at least one or more prior the image forming condition stored by said memory means.

3. An image forming apparatus as defined in claim 1, wherein said correcting means corrects the image forming condition automatically.

4. An image forming apparatus as defined in claim 1, wherein said counting means starts to count the number of images formed by said image forming means when said regulating means finishes regulating the image forming condition.

5. An image forming apparatus as defined in claim 1, wherein said revising means revises the correction value when regulating means finishes regulating the image forming condition.

6. An image forming apparatus as defined in claim 1, wherein said counting means changes a counting value in accordance with the size of recording paper.

7. An image forming apparatus as defined in claim 1, wherein said counting means changes a counting value to be twice of a regular counting value when a paper size is larger than a regular paper size.

8. An image forming apparatus as defined in claim 1, wherein said regulating means regulates the correction value in accordance with the following equation $$\{(V11-V10)/(No-MCNT1)\}*MCNT20,$$

wherein said V11 is a exposure lamp voltage at the present time, said V10 is at least one or more prior exposure lamp voltage including the initial value, said No is the number of copies corresponding to life of photosensitive member, said MCNT1 is the number of copies at the present time and said MCNT20 is a designated number of copies.

9. An image forming apparatus comprising:

an image bearing member;

image forming means for forming an image by forming an electrostatic latent image on said image bearing member in accordance with an image forming condition, and developing the electrostatic latent image;

detecting means for detecting a situation of use of the apparatus;

correcting means for correcting the image forming condition in accordance with a correction value and a result of said detecting means every a predetermined cycle;

regulating means for manually regulating the image forming condition corrected by said correcting means; and revising means for revising the correction value in accordance with the image forming condition regulated by said regulating means, so that the following correction of image forming condition by said correcting means is executed in accordance with the correction value revised by said revising means.

10. An image forming apparatus as defined in claim 9, wherein said detecting means detects the number of image formed by said image forming means and the image forming condition.

11. An image forming apparatus as defined in claim 10, wherein the image forming condition detected by said detecting means is an exposure lamp voltage.

12. An image forming apparatus as defined in claim 10, wherein said image forming conditions detected by said detecting means is an amount of charge applied to said image bearing member.

13. An image forming apparatus as defined in claim 10, wherein said image forming conditions detected by said detecting means is a developing bias voltage.

14. An image forming apparatus comprising:

an image bearing member;

image forming means for forming an image by forming an electrostatic latent image on said bearing member in accordance with an image forming condition, and developing the electrostatic latent image;

counting means for counting the number of images formed by said image forming means;

correcting means for correcting the image forming condition in accordance with a correction value whenever a predetermined number is counted by said counting means;

regulating means for manually regulating the image forming condition corrected by said correcting means; and revising means for revising the predetermined number in accordance with the image forming condition, so that the following correction of image forming condition by said correcting means is executed in accordance with the number revised by said revising means.

* * * * *